US005588821A

United States Patent [19]

Kinoshita

[11] Patent Number: 5,588,821

[45] Date of Patent: Dec. 31, 1996

[54] VACUUM PUMP WITH PLANETARY GEAR ACCELERATOR

[75] Inventor: Takashi Kinoshita, Hyogo, Japan

[73] Assignee: Mitsubishi Denki Kabushiki Kaisha, Tokyo, Japan

[21] Appl. No.: 451,428

[22] Filed: May 26, 1995

[30] Foreign Application Priority Data

Nov. 4, 1994 [JP] Japan ..... 6-271452

[51] Int. Cl.[6] ..... F04C 18/344; F04C 25/02

[52] U.S. Cl. ..... 418/259; 418/270

[58] Field of Search ..... 418/259, 270; 415/122.1; 417/423.6; 123/559.1; 475/31

[56] References Cited

U.S. PATENT DOCUMENTS 2,344,078 3/1944 Brissonet et al. ..... 123/559.1
5,063,904 11/1991 Winkelmann et al. ..... 123/559.1

FOREIGN PATENT DOCUMENTS 1353956 1/1964 France ..... 417/423.6
63-39436 10/1988 Japan .
774692 5/1957 United Kingdom ..... 415/122.1
938148 10/1963 United Kingdom ..... 417/423.6

*Primary Examiner*—John J. Vrablik
*Attorney, Agent, or Firm*—Sughrue, Mion, Zinn, Macpeak & Seas

[57] ABSTRACT

A vacuum pump with a planetary gear accelerator which comprises: a pump chamber formed in a pump housing; a pump rotor accommodated in said pump chamber; a rotor shaft attached to said pump rotor; a sun gear formed on this rotor shaft; and planetary gears arranged so as to constitute a planetary gear device together with said sun gear and connected to an input shaft, said planetary gear device having a gear ratio which is set so that the rotation of said pump rotor is accelerated relative to the rotation of said input shaft. Thus, the vacuum properties of the engine at times of low-speed rotation are stabilized, and high vacuum properties are guaranteed. Moreover, in addition to seeking a more compact and light-weight design, the intensiveness and standardization of vacuum pumps meeting the maximum performance requirements are realized.

16 Claims, 4 Drawing Sheets

H
1b
12
3
14
35
31
2
1
5
36
6
38
39
11
10
8
30
7
1a
7a
37
34
33
32
G
33a
1e
1c 9
1b
H
12
2
1a
3
1
13
6
9
4
8
11
10
7
1e
7a
5
1c
9

1b
1
1a
5
5
6
7
7a
1c
ROTATION DIRECTION

VACUUM PUMP WITH PLANETARY GEAR ACCELERATOR

BACKGROUND OF THE INVENTION

1. Field of the Invention

The present invention relates to a vacuum pump with planetary gear accelerator in which a planetary gear accelerator is attached to a vacuum pump such as a rotary displacement vacuum pump (for example, a vane vacuum pump) used to operate a servo assisted brake or actuator in an automobile, for example.

2. Description of the Related Art

FIG. 8 is a cross-sectional view showing one example of a vane vacuum pump used in a servo assisted brake of an automobile, for example. In the drawing, H is a pump housing which is composed of a pump chamber part 1 and a bracket 2. An O-ring 3 is provided to seal a clearance between the pump chamber part 1 and the bracket 2, and another O-ring 4 is provided to seal off a faucet attachment (not illustrated) provided in an engine body. The reference numeral 5 designates a vane, 6 a rotor, and 7 a rotor shaft. As shown in FIG. 9, the vane 5 is installed or fitted in the rotor 6 so that it slides freely in grooves of a radial configuration. One end of the rotor shaft 7 is attached to the rotor 6 by the engagement with a spline 7*a*, while the other end of the same is formed so as to pass through the bracket 2 and projecting to the exterior. Bearings 8 and 9 of the rotor shaft 7 are provided so that the bearing 8 is arranged in the pump chamber part 1, while the bearing 9 is arranged in the bracket 2. The rotor 6 is arranged so that it rotates with an eccentricity of specified dimensions relative to the center of the pump chamber 1*a*, as shown in FIG. 9. A coupling 10 is attached by a pin 11 to the tip of the rotor shaft 7 which penetrates the bracket 2 and projects to the exterior. A bolt 12 is provided to fasten the pump chamber part 1 and the bracket 2. A retaining ring 13 is provided for positioning the bearing 9 which supports the rotor shaft 7. The pump chamber part 1 is provided with an inlet 1*b* and an outlet 1*c*. The pump chamber part 1 is further provided with a lubricator 1*e* which supplies engine oil for maintaining airtightness by oil among the rotor 6, the pump chamber part 1 and bracket 2; for lubricating to prevent wear among the bearing 8, the rotor 6 and rotor shaft 7; for lubricating the bearing 9; and further for lubricating, for maintaining airtightness, and for preventing wear among the vane 5, the pump chamber part 1 and the bracket 2.

Next, the operation will be explained. In this vane vacuum pump, the coupling 10 is connected to another coupling (not illustrated) of the engine side so that the rotational force is transmitted through these couplings. The rotor 6 rotates due to this rotational force, and then the vane 5 slidably fitted in the rotor 6 starts moving due to centrifugal force so as to slide along the inner circumference of the pump chamber 1*a*. As is common knowledge, air is sucked in from the inlet 1*b* due to the sliding of this vane 5, and exhaust air is discharged via the outlet 1*c*. By the repetition of this suction and discharge of air, negative pressure is supplied to a servo assisted brake or actuator or the like to which the inlet 1*b* is joined.

The performance of the above type of conventional vane vacuum pump is determined by the product of the rotational speed (rotation number per unit time) and the displacement per rotation of the vane pump. Accordingly, during low-speed rotation of the engine, there is a problem that the force of movement of the vane which is based on centrifugal force declines, and the vacuum properties weaken and become unstable. To meet the demands of large capacity vacuum performance, it is necessary to either increase the displacement per rotation, or raise the rotational number per unit of time. However, there are problems that the vane pump must be made large-sized in order to increase the displacement per rotation, and that the raising of the rotational number per unit of time is difficult because of difficulty in obtaining a required rotational speed due to limitations on the engine size. Furthermore, there is also a problem that, due to the driving conditions (installation space, rotational speed, performance requirements, etc.), the number of types of vane vacuum pumps required for every different displacement becomes large.

SUMMARY OF THE INVENTION

The present invention was made in order to eliminate the aforementioned problems, and an object thereof is to stabilize the vacuum properties at times of low-speed rotation of the engine and to secure superior vacuum properties.

Another object of the present invention is to bring about a more compact and light-weight product, and to make vane vacuum pumps have maximum performance.

In order to attain the above objects, according to an aspect of the present invention, the vacuum pump with a planetary gear accelerator includes: a pump chamber formed in a pump housing; a pump rotor accommodated in the pump chamber; a rotor shaft attached to the pump rotor; a sun gear formed on this rotor shaft; and planetary gears arranged so as to constitute a planetary gear device together with the sun gear and connected to an input shaft, the planetary gear device having a gear ratio which is set so that the rotation of the pump rotor is accelerated relative to the rotation of the input shaft.

Preferably, the planetary gear device is accommodated in the pump housing and is provided with a ring gear which engages with the planetary gears.

Preferably, the planetary gear device is accommodated in an input shaft attachment bracket to which the input shaft is attached, and is provided with a ring gear which engages with the planetary gears.

Further, preferably the ring gear is formed by a toothed wheel cutting on the inside of the pump housing or on the inside of the input shaft attachment bracket.

According to another aspect of the present invention, the vacuum pump with a planetary gear accelerator includes: a pump chamber formed in a pump housing; a pump rotor accommodated in the pump chamber; a rotor shaft attached to the pump rotor; a sun gear formed in the rotor shaft; a ring gear connected to an input shaft; and planetary gears arranged so as to constitute a planetary gear device together with the ring gear and the sun gear, the planetary gears being supported by a stationary part, the planetary gear device having a gear ratio which is set so that the rotation of the pump rotor is accelerated relative to the rotation of the input shaft.

Preferably one end of the rotor shaft is supported by a bearing provided at one end of the input shaft.

In the vacuum pump with a planetary gear accelerator which is configured in the above manner, the pump rotor rotates at a high speed, the vacuum pump is made more compact, and the vacuum properties are stabilized, with the result that the planetary gear accelerator operates so as to make the types of vacuum pumps intensive.

Moreover, when the inner gear of the planetary gear device is formed through a toothed wheel cutting of the inner side of the pump housing or the input shaft attachment bracket, costs of the planetary gear device can be reduced.

Furthermore, when the bearing which supports the other end of the rotor shaft is provided at the interior of the input shaft connected to the planetary gear device so as to be integrated with this input shaft, the overall length of the vacuum pump can be reduced.

DETAILED DESCRIPTION OF THE PREFERRED EMBODIMENTS

The vacuum pump according to embodiments of the present invention will be explained with reference to the accompanying drawings.

Embodiment 1

Figure 1:
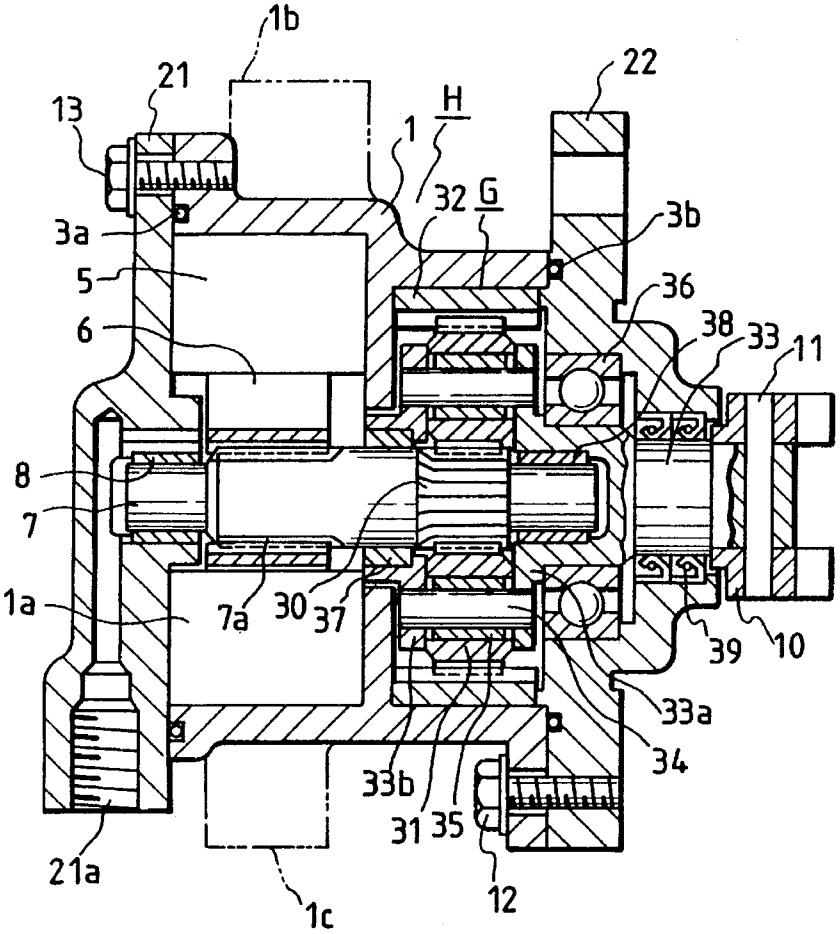
FIG. 1 is a cross-sectional view of a vacuum pump according to a first embodiment of the present invention.

In FIG. 1, a pump housing H comprises a pump chamber 1, an attachment bracket 22, a pump side bracket 21, etc. An O-ring 3*a* is provided to conduct sealing between the pump chamber 1 and the pump side bracket 21, and another O-ring 3*b* is provided to conduct sealing between the pump chamber 1 and the attachment bracket 22. A pump chamber la has an inlet 1*b* and an outlet 1*c*. The reference numeral 5 designates a vane; 6, a rotor; and 7, a rotor shaft. The configuration in which the vane 5 is arranged so as to slide freely in a radial groove provided in the rotor 6, the rotor 6 is attached to one end of the rotor shaft 7, etc. is identical to that of the aforementioned conventional vacuum pump. A bearing 8 is provided in the pump side bracket 21 so as to support one end of the rotor shaft 7.

A planetary gear device G has a conventional configuration comprising a sun gear 30, planetary gears 31, and a ring gear 32. In this case, the sun gear 30 is formed by a toothed wheel cutting of the other end of the rotor shaft 7, or by attachment of a gear which has undergone toothed wheel cutting, to the rotor shaft 7. The ring gear 32 is attached and fastened to the attachment bracket 22 of the pump chamber part 1 so as to be incapable of rotary movement. Ordinarily, three planetary gears 31 are used for engagement with the sun gear 30 and the ring gear 32. An input shaft 33 is provided with a flange 33*a* at one end to secure it with the planetary gears 31. That is, pins 34 are provided to hold the planetary gears 31, and a bearing 36 is press-fitted to the planetary gears 31 so as to be rotatable. The pins 34 to which the planetary gears 31 are fitted are secured by a flange 33*a* and a holder 33*b*. The input shaft 33 on which the planetary gears 31 are secured is rotatably supported by the bearing 36 provided on the attachment bracket 22 and rotatably supported on the rotary shaft 7 by another bearing 37 provided on part of the holder 33*b*. Although the rotational frequency of the conventional rotor 6 was 300 to 3,000 rpm, the gear ratio of the planetary gear device G is set so that, for example, the rotational frequency of the rotor 6 can be accelerated in a range of from 1,200 to 12,000 rpm relative to the rotational frequency of 300 to 3,000 rpm of the input shaft 33.

A further bearing 38 is provided at the center of the input shaft 33 so as to support the other end of the rotor shaft 7. An oil seal 39 is provided in the attachment bracket 22 so as to seal off the input shaft 33. A coupling 10 is positioned by the pin 11 at the tip of the input shaft 33, and arranged to be incapable of rotary movement at the periphery of the input shaft 33. A bolt 12 is provided to fasten the pump chamber part 1 and the attachment bracket 22, and another bolt 13 is provided to fasten the pump chamber part 1 and the pump side bracket 21. A lubricator 21*a* is provided to supply engine oil for maintenance of airtightness by oil among the rotor 6, the pump chamber part 1, and the bracket 22; for lubrication to prevent wear among the bearing 8, the rotor 6, and the shaft 7; for lubrication of the bearing 36; and further for lubrication, maintenance of airtightness and prevention of wear among the vane 5, the pump chamber part 1, and the bracket 22.

In the vacuum pump with a planetary gear accelerator which is configured in the above manner, the coupling 10 is connected to the engine side coupling (not illustrated) so that the rotary force is transmitted. As a result of this rotary force, the rotor 6 is rotated at a high speed via the planetary gear device G which is set at a specified acceleration gear ratio. Due to this rotation, the vanes 5, which are installed in the rotor 6 so as to be freely slidable, are set in motion by centrifugal force, slide along the inner circumference of the pump chamber 1*a*, and conduct the pumping action. This pumping action is identical to the conventional type, except that, due to a high-speed rotation, the pumping action is more reliable and displacement is increased.

Embodiment 2

Figure 2:
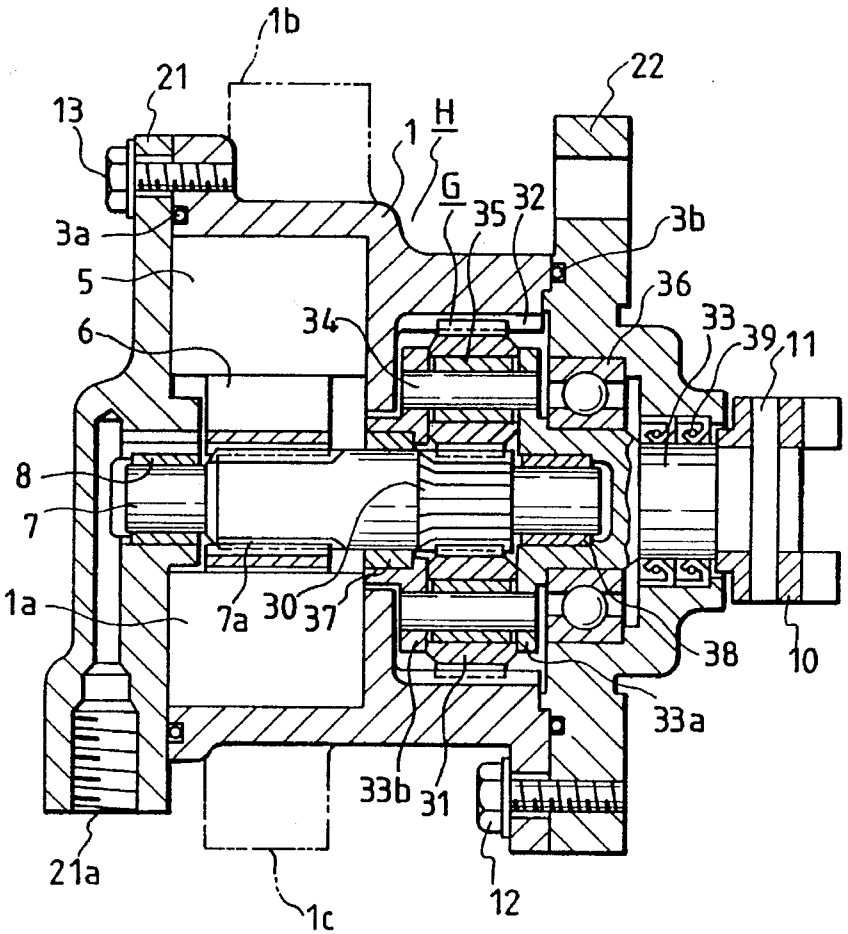
FIG. 2 is a cross-sectional view of a vacuum pump according to a second embodiment of the present invention.

In the above embodiment 1, the ring gear 32 is fitted and fastened to the attachment bracket 22 of the pump chamber part 1. However, if the ring gear is formed by a toothed wheel cutting of the inner side of the pump housing H as shown in FIG. 2, the configuration is simplified and costs are reduced. That is, in this embodiment, a ring gear 32 is formed by toothed wheel cutting of the inner side of the attachment bracket 22 in the pump chamber part 1. The remainder of the configuration is identical to embodiment 1.

Embodiment 3

Figure 3:
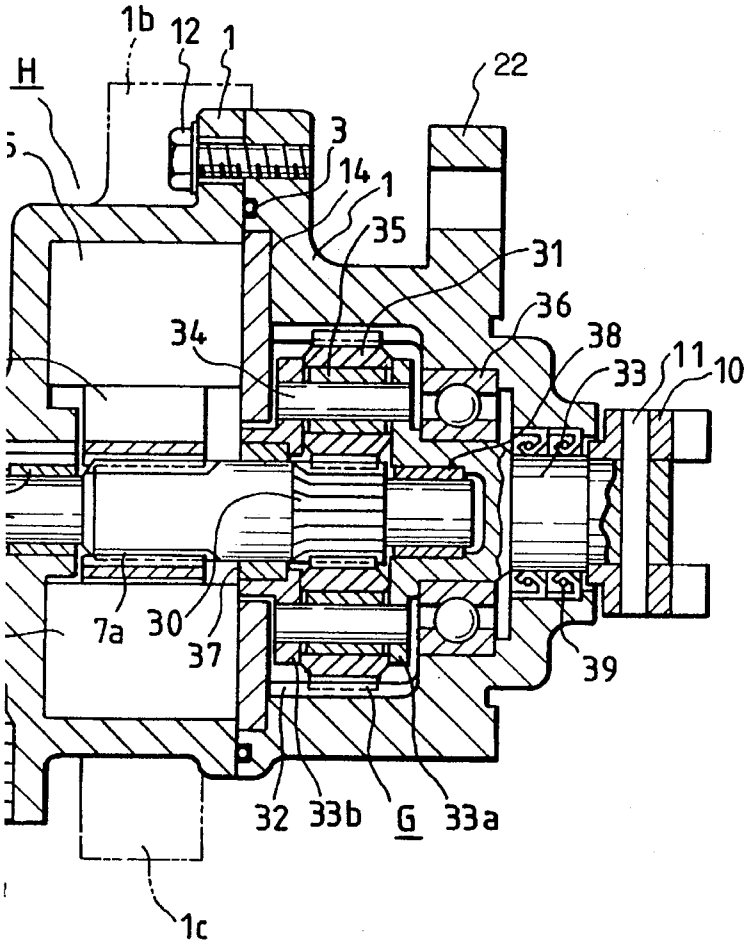
FIG. 3 is a cross-sectional view of a vacuum pump according to a third embodiment of the present invention.

In this embodiment, as well, a ring gear 32 is formed by conducting toothed wheel cutting, or molding and casting of the inner side of the pump housing H. That is, as shown in FIG. 3, an attachment bracket 22 of this embodiment is configured to a size which allows incorporation of a planetary gear device G, and the ring gear 32 is formed by toothed wheel cutting, or molding and casting of the inner side of the pump housing. The configuration in which a flange 33*a* is provided in planetary gears 31, a sun gear 30, and an input shaft 33 to secure the planetary gears 31 is identical to embodiment 1. The fastening of the attachment bracket 22 and a pump chamber part 1 is accomplished by a bolt 12. In this case, the border of the attachment bracket 22 and the pump chamber part 1 is configured so as to be delimited by a partitioning board 14. The reference numeral 3 designates an O-ring used for sealing.

Embodiment 4

Figure 4:
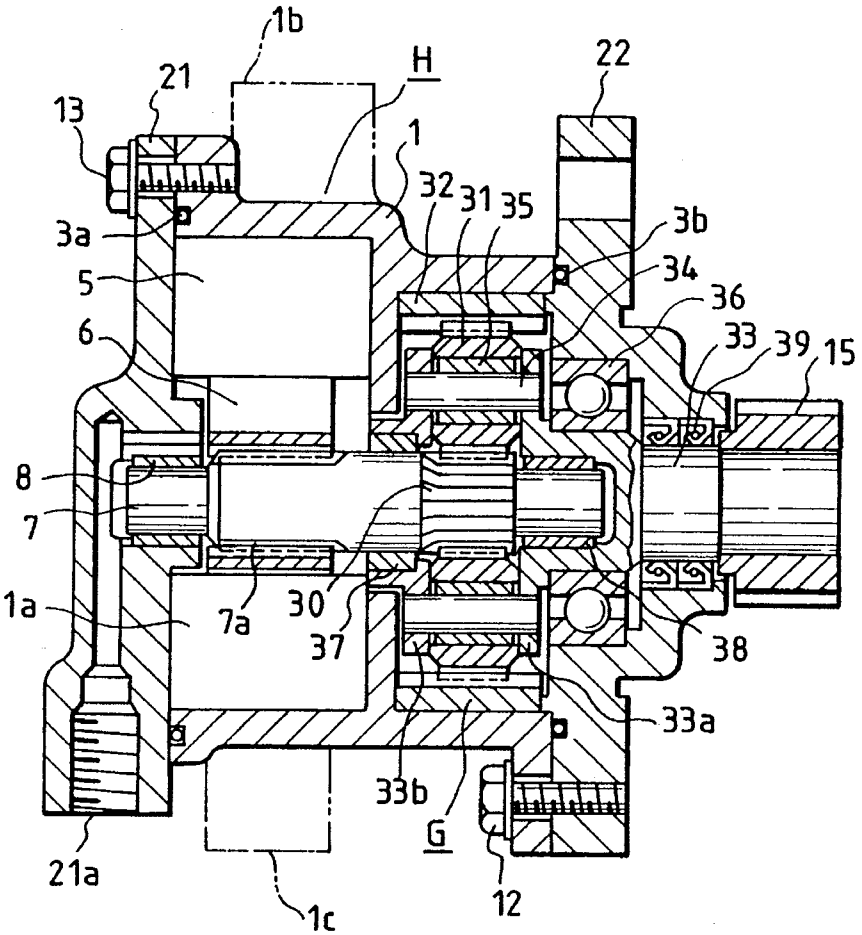
FIG. 4 is a cross-sectional view of a vacuum pump according to a fourth embodiment of the present invention.

In the above embodiments 1 to 3, it was shown that the engine and the input shaft 33 are connected by the coupling 10, but in this embodiment, they are connected by a pinion gear 15. That is, as shown in FIG. 4, the pinion gear 15 is fastened to the input shaft 33, and the remainder of the configuration is identical to the embodiment 1. If the pinion gear 15 is used, the gear ratio can be adjusted with this part, as well.

Embodiment 5

Figure 5:
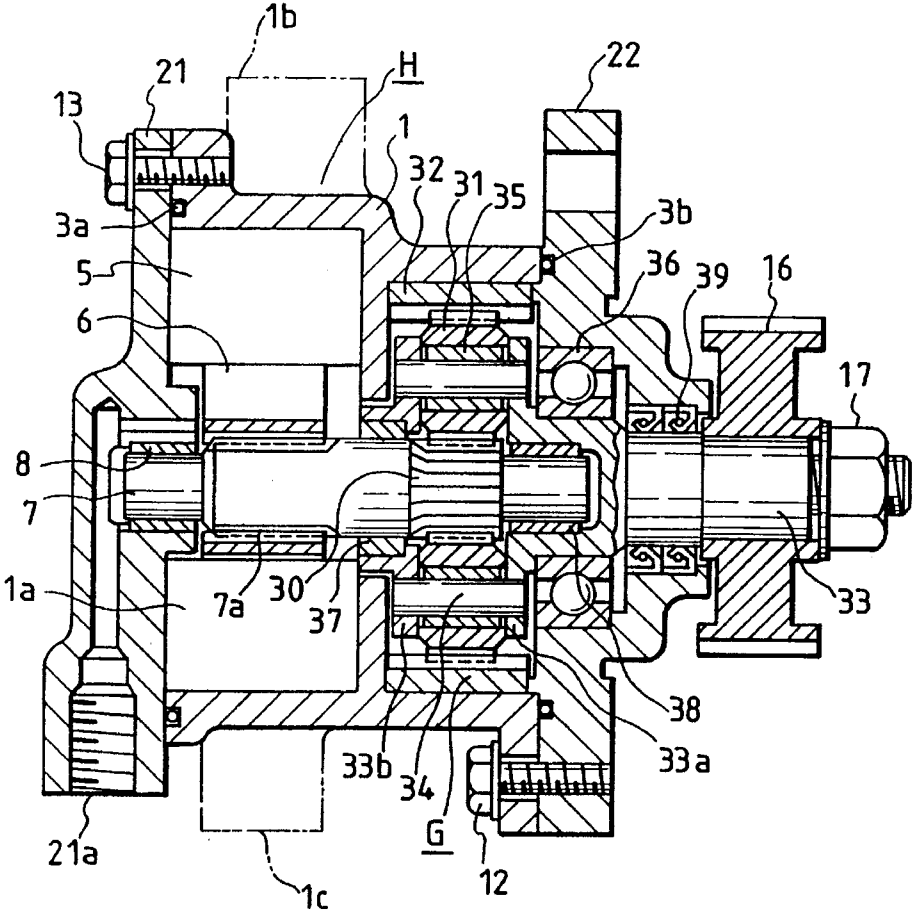
FIG. 5 is a cross-sectional view of a vacuum pump according to a fifth embodiment of the present invention.

In the embodiment 4, it was shown that the engine and the input shaft 33 are connected by the pinion gear 15, but in this embodiment, the connection is effected with use of a pulley 16. That is, as shown in FIG. 5, the pulley 16 is fastened to the input shaft 33, and a nut 17 fastens the pulley 16. The remainder of the configuration is identical to the embodiment 1. Since the pulley 16 effects the connection with use of a belt, and since it does not have to be directly connected to the engine, the limitations on the connection position are reduced.

Embodiment 6

Figure 6:
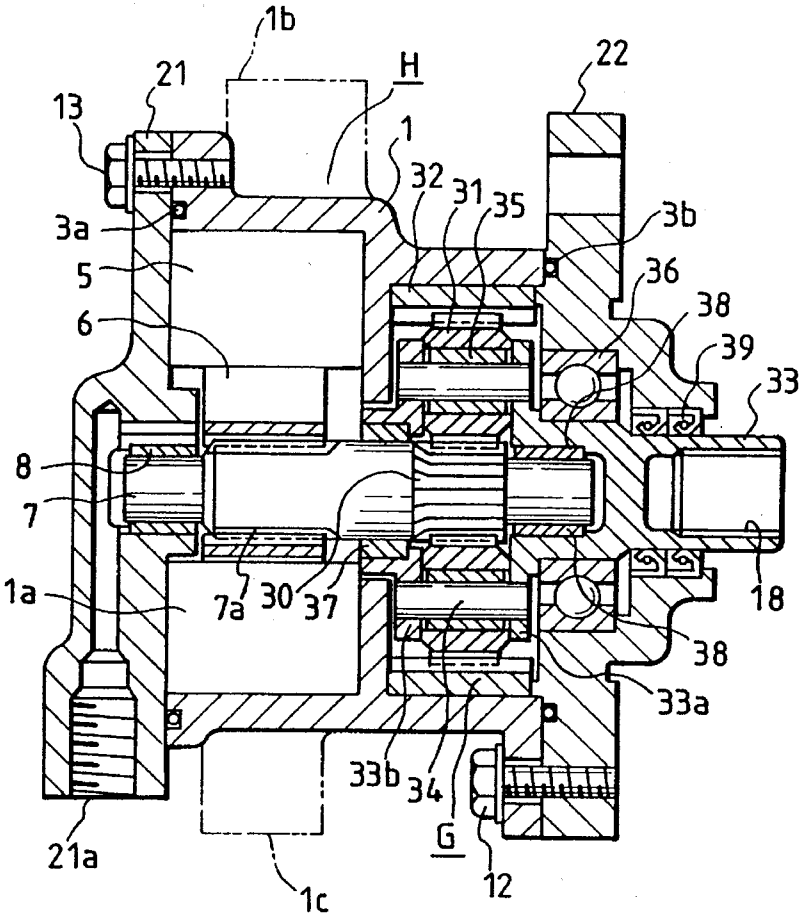
FIG. 6 is a cross-sectional view of a vacuum pump according to a sixth embodiment of the present invention.

In this embodiment, as well, the means of connection of the engine and the input shaft 33 is changed. That is, as shown in FIG. 6, a spline 18 is provided in the input shaft 33, and is connected with the spline shaft provided on the engine side. The remainder of the configuration is identical to the embodiment 1. In this embodiment, the spline 18 of the input shaft 33 is configured with internal teeth, but external teeth are also acceptable. By means of this spline connection, since neither pinion gear nor pulley are used, the configuration is simplified.

Embodiment 7

Figure 7:
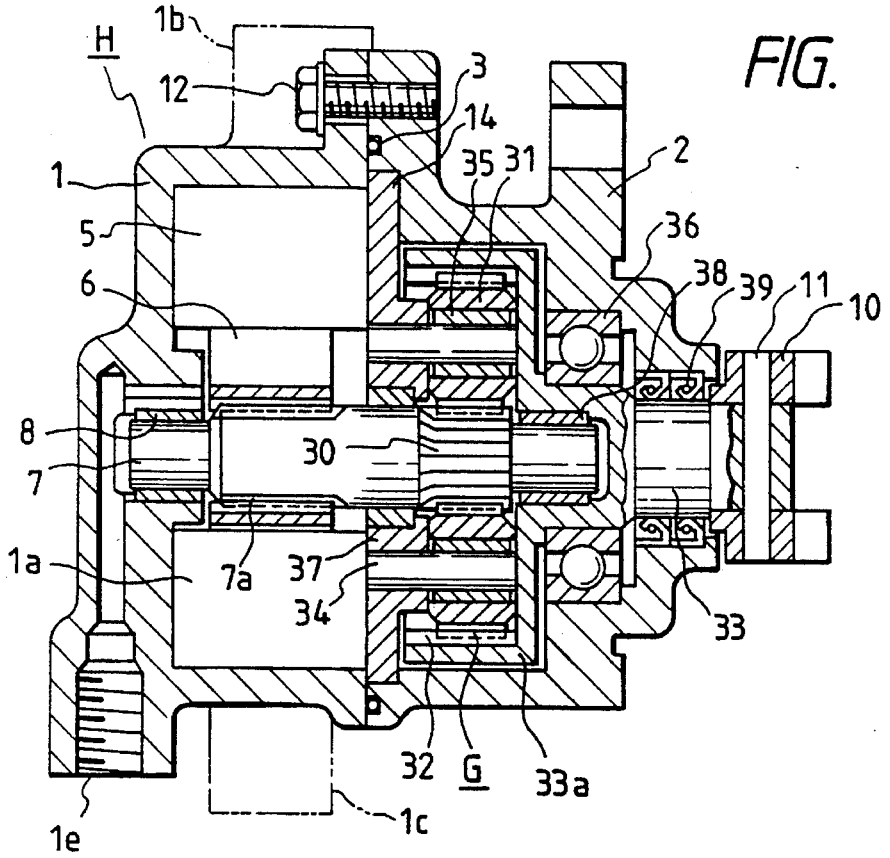
FIG. 7 is a cross-sectional view of a vacuum pump according to a seventh embodiment of the present invention.
Figure 8:
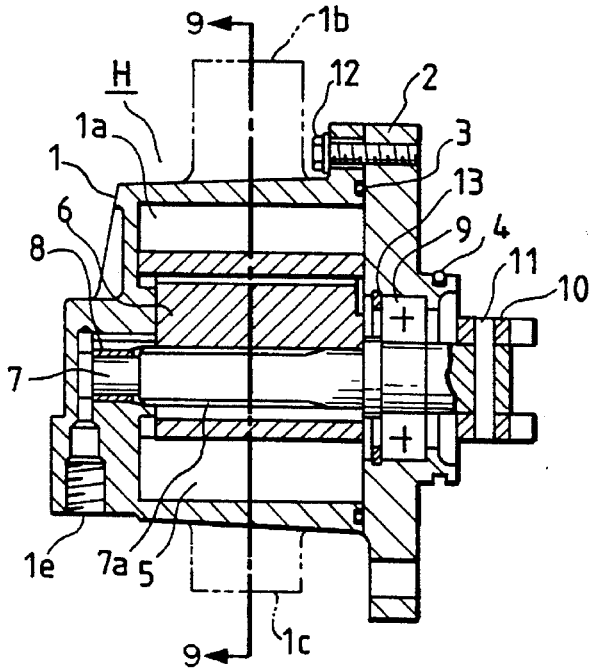
FIG. 8 PRIOR ART
FIG. 8 is a cross-sectional view showing a conventional vacuum pump.
Figure 9:
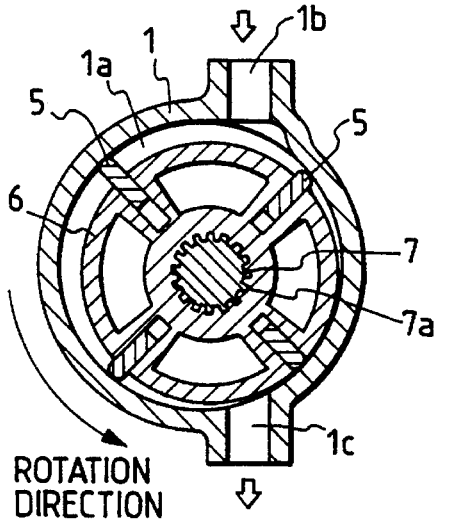
FIG. 9 PRIOR ART
FIG. 9 is a cross-sectional view of the conventional vacuum pump cut away along a line 9—9 of FIG. 8.

In the above embodiments 1 to 6, it is shown that the ring gear 32 of the planetary gear device G is arranged on the inner side of the pump housing H, and that the planetary gears 31 are secured on the input shaft 33, but a configuration may also be adopted where the ring gear 32 is turned by the input shaft 33. That is, as shown in FIG. 7, the input shaft 33 has a cup-shaped flange 33*a* provided at its one end, and a ring gear 32 provided on the inner side. A partitioning board 14 is attached to the flange 2 so that the pins 34 are implanted in this partitioning board 14, and the planetary gears 31 are rotatably inserted onto the pins 34 respectively. As a result of this configuration, the planetary gears 31 only rotate relative to the sun gear 30, but since the ring gear 32 turns, the sun gear 30, that is, the rotor 6, rotates at a high speed due to this turning. The partitioning board 14 is configured to serve the additional function of a partitioning board for the border of the attachment bracket 2 and the pump chamber part 1. The remaining parts are identical to the configuration of embodiment 2. In this embodiment, the relational dimensions of the sun gear which is arranged in the rotor shaft 7 and the ring gear 32 are accurate, and the planetary gears 31 are correctly arranged between the sun gear 30 and the ring gear 32.

Since the present invention is configured as explained above, it exhibits the following effects.

As a result of the acceleration by the planetary gear device, vacuum properties are stabilized at times of low-speed rotation, and it becomes possible to have large capacity vacuum pumps which are more compact and light-weight. Consequently, the types of vacuum pump can be intensive, and costs can be reduced.

Moreover, the formation of the internal gears of the planetary gear device on the inner side of the pump housing or the input shaft attachment bracket as an integral part of the bracket further contributes to cost reduction.

In addition, the bearing which supports the other end of the rotor shaft is provided inside the input shaft which is connected to the planetary gear device as an integral part of the said input shaft, and this allows the shortening of the overall length of the vacuum pump.

What is claimed is:

1. A vacuum displacement pump for use in a servo assisted brake or actuator in an automobile, said vacuum displacement pump comprising:

a housing having a pump chamber;

an input shaft for providing a rotational force to said vacuum pump;

a rotor shaft connected to said input shaft and receiving a rotational force therefrom;

a rotor eccentrically mounted in said pump chamber and connected to said rotor shaft and receiving a rotational force therefrom;

a pump chamber assembly comprising:

an inlet for permitting entrance of a gas into said pump chamber;

an outlet for expelling said gas from said pump chamber;

a plurality of vanes, each vane slidably disposed in a groove of said rotor, wherein a suction is created in said pump chamber resulting from movement of said vanes due to a force created by the rotation of said rotor;

a planetary gear device comprising:

a sun gear located on said rotor shaft;

a plurality of planetary gears connected to said input shaft and engaging said sun gear;

a ring gear which engages said planetary gears, wherein said planetary gear device has a gear ratio which is set so that the rotation of said rotor is accelerated relative to the rotation of said input shaft.

2. A vacuum pump with a planetary gear accelerator according to claim 1, wherein said ring gear is formed by a toothed wheel cutting on an inside of said housing of said vacuum displacement pump.

3. A vacuum pump with a planetary gear accelerator according to claim 1, wherein one end of said rotor shaft is supported by a bearing which is provided at one end of said input shaft.

4. A vacuum pump with a planetary gear accelerator according to claim 1, wherein a pinion gear is fastened to said input shaft for further adjustment of said gear ratio.

5. A vacuum pump with a planetary gear accelerator according to claim 1, wherein a pulley is fastened to said input shaft for a belt-driven operation.

6. A vacuum pump with a planetary gear accelerator according to claim 1, wherein a spline is provided on said input shaft, said spline being configured with either external teeth or internal teeth.

7. A vacuum pump with a planetary gear accelerator according to claim 1, wherein said planetary gear device is accommodated in an input shaft attachment bracket to which said input shaft is attached.

8. A vacuum pump with a planetary gear accelerator according to claim 4, wherein said ring gear is formed by a toothed wheel cutting on the inside of said input shaft attachment bracket.

9. A vacuum pump with a planetary gear accelerator according to claim 4, wherein a partition separates said input shaft attachment bracket from the remainder of said housing of said vacuum displacement pump.

10. A vacuum displacement pump for operating a servo assisted brake or actuator in an automobile, said vacuum displacement pump comprising:

a housing having a pump chamber;

an input shaft assembly for providing a rotational force to said vacuum displacement pump;

a rotor shaft assembly comprising:

a rotor shaft connected to said input shaft assembly and receiving a rotational force therefrom;

a rotor eccentrically mounted in said pump chamber and connected to said rotor shaft and receiving a rotational force therefrom;

a pump chamber assembly comprising:

an inlet for permitting entrance of a gas into said pump chamber;

an outlet for expelling said gas from said pump chamber;

a plurality of vanes, each vane slidably disposed in a groove of said rotor, wherein a suction is created in said pump chamber resulting from movement of said vanes due to a centrifugal force caused by the rotation of said rotor;

a planetary gear assembly comprising:

a sun gear formed on said rotor shaft;

a plurality of planetary gears connected to said input shaft and engaging said sun gear;

a ring gear which engages said planetary gears, wherein said planetary gear device has a gear ratio which is set so that the rotation of said rotor is accelerated relative to the rotation of said input shaft.

11. A vacuum displacement pump according to claim 10, wherein said ring gear is formed by a toothed wheel cutting on the inside of said housing of said vacuum displacement pump.

12. A vacuum displacement pump according to claim 10, wherein a spline is provided on said input shaft assembly, said spline being configured with either external teeth or internal teeth.

13. A vacuum displacement pump according to claim 10, wherein said input shaft assembly further comprises an input shaft attachment bracket which accommodates said planetary gear device.

14. A vacuum displacement pump according to claim 13, wherein said input shaft assembly may further comprise a pinion gear attached for further adjustment of said gear ratio, or a pulley fastened thereto for a belt-driven operation.

15. A vacuum displacement pump according to claim 13, wherein said ring gear is formed by a toothed wheel cutting on the inside of said housing of said vacuum displacement pump.

16. A vacuum displacement pump according to claim 13, wherein a partition board separates said input shaft attachment bracket from the remainder of said housing of said vacuum displacement pump.

* * * * *